US009257223B2

(12) United States Patent
Samata et al.

(10) Patent No.: US 9,257,223 B2
(45) Date of Patent: Feb. 9, 2016

(54) INDUCTOR

(71) Applicant: TAIYO YUDEN CO., LTD., Taito-ku, Tokyo (JP)

(72) Inventors: Takahiro Samata, Gunma (JP); Hideki Ogawa, Gunma (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 13/932,701

(22) Filed: Jul. 1, 2013

(65) Prior Publication Data

US 2014/0009252 A1 Jan. 9, 2014

(30) Foreign Application Priority Data

Jul. 4, 2012 (JP) ..... 2012-150164

(51) Int. Cl.

| | |
|---|---|
| ***H01F 27/02*** | (2006.01) |
| ***H01F 27/30*** | (2006.01) |
| ***H01F 27/29*** | (2006.01) |
| ***H01F 17/04*** | (2006.01) |
| ***H01F 27/255*** | (2006.01) |

(52) U.S. Cl.

CPC ..... *H01F 27/022* (2013.01); *H01F 17/045* (2013.01); *H01F 27/255* (2013.01)

(58) Field of Classification Search

USPC ..... 336/83, 96, 185, 192

See application file for complete search history.

(56) References Cited

U.S. PATENT DOCUMENTS

| | | | | |
|---|---|---|---|---|
| 2002/0097124 | A1* | 7/2002 | Inoue et al. | 336/83 |
| 2002/0113680 | A1* | 8/2002 | Kato et al. | 336/83 |
| 2005/0212643 | A1* | 9/2005 | Kuroiwa et al. | 336/200 |
| 2008/0309443 | A1* | 12/2008 | Furuya | 336/83 |
| 2009/0212894 | A1* | 8/2009 | Hsieh et al. | 336/83 |
| 2009/0306272 | A1* | 12/2009 | Nishi et al. | 524/493 |
| 2010/0182115 | A1* | 7/2010 | Huang et al. | 336/83 |
| 2012/0038449 | A1* | 2/2012 | Ogawa et al. | 336/221 |

FOREIGN PATENT DOCUMENTS

| | | | |
|---|---|---|---|
| JP | 09180924 | A * | 7/1997 |
| JP | 2003306704 | A * | 10/2003 |
| JP | 2004014614 | A * | 1/2004 |
| JP | 2009-260116 | A | 11/2009 |

OTHER PUBLICATIONS

A Notification of Examination Opinions with Search Report issued by Taiwan Intellectual Property Office, mailed Jul. 25, 2014, for Taiwan counterpart application No. 102122593.

* cited by examiner

*Primary Examiner* — Tsz Chan

(74) *Attorney, Agent, or Firm* — Law Office of Katsuhiro Arai

(57) ABSTRACT

An inductor includes soft magnetic alloy powder-containing resin that contains amorphous soft magnetic alloy powder, which resin is used as a sealing material that seals a coil wound around a winding core of the core. This soft magnetic alloy powder-containing resin contains two groups of large and small particles having a first peak and second peak in their particle size distribution, where the particle size corresponding to the second peak is equal to or smaller than one-half the particle size corresponding to the first peak, and the magnitude ratio (abundance ratio) of the second peak and first peak is 0.2 or more but 0.6 or less. The inductor demonstrates improved DC superimposition characteristics and does not cause sealing irregularities.

12 Claims, 4 Drawing Sheets

INDUCTOR

BACKGROUND

1. Field of the Invention

The present invention relates to an inductor, and specifically to a coil-type inductor.

2. Description of the Related Art

Inductors do not permit high-frequency components to easily pass through and are therefore used in filters and power circuits for noise elimination, smoothing, etc. Inductors are structurally classified into the coil type, laminated type, thin-membrane type, etc., among which, coil-type inductors are frequently used particularly in DC-DC converters and other applications where large current is applied.

Recent years have seen a growing demand for smaller inductors with an increase in the component mounting density of electronic devices. However, a smaller inductor means a reduced volume of the inductor core (core made of magnetic material), which makes the inductor prone to deterioration of DC superimposition characteristics (inductance when a DC current load is applied).

As a result, inductors whose DC superimposition characteristics will not deteriorate even when the inductor size is reduced, are desired.

Patent Literature 1 mentioned below discloses a technology relating to a mold coil whose structure is such that the coil is sealed by magnetic mold resin (resin with magnetic powder dispersed in it) (hereinafter referred to as "prior art"). It is stated that, according to this prior art, excellent DC superimposition characteristics can be obtained (Paragraph [0011] in the literature).

BACKGROUND ART LITERATURES

[Patent Literature 1] Japanese Patent Laid-open No. 2009-260116

SUMMARY

However, the aforementioned prior art seals the coil by "pressure-molding" the magnetic mold resin, which makes it impossible to assure smooth fluidity of magnetic mold resin and may allow voids to remain between loops of the wound coil (hereinafter referred to as "sealing irregularities").

In light of the above, an object of the present invention is to provide an inductor that demonstrates improved DC superimposition characteristics and does not cause sealing irregularities.

The inductor pertaining to the present invention is an inductor that uses soft magnetic alloy powder-containing resin that contains amorphous soft magnetic alloy powder for the sealing material that seals the coil wound around the winding core of the core, wherein such inductor is characterized in that: the soft magnetic alloy powder-containing resin contains two groups of large and small particles having a first peak and second peak in their particle size distribution, where the particle size corresponding to the second peak is one-half the particle size corresponding to the first peak, and a magnitude ratio (abundance ratio) of the second peak and first peak is 0.2 or more but 0.6 or less.

According to the present invention, an inductor can be provided that demonstrates improved DC superimposition characteristics and does not cause sealing irregularities.

Any discussion of problems and solutions involved in the related art has been included in this disclosure solely for the purposes of providing a context for the present invention, and should not be taken as an admission that any or all of the discussion were known at the time the invention was made.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
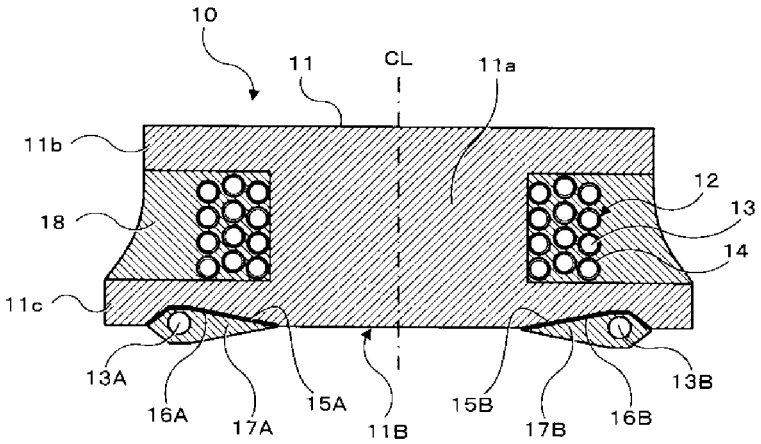
FIG. 1 is a section view of the inductor pertaining to an embodiment.

11 Core
11*a* Winding core
12 Coil
18 Sealing material

DETAILED DESCRIPTION OF EMBODIMENTS

An embodiment of the present invention is explained below by referring to the drawings.

FIG. 1 is a section view of the inductor pertaining to the embodiment.

In this figure, an inductor 10 has: a core 11; a coil 12 wound around the core 11; a pair of electrodes 16A, 16B for connecting ends 13A, 13B of the coil 12; and a sealing material 18 that coats and seals the outer periphery of the coil 12.

The core 11 has: a winding core 11*a* of specified axis length and columnar shape around which the coil 12 is wound; a top flange 11*b* formed integrally on one end (top end with reference to the drawing sheet) of the winding core 11*a*; and a bottom flange 11*c* formed integrally on the other end (bottom end with reference to the drawing sheet) of the winding core 11*a*.

Preferably the winding core 11*a* has a section whose shape is a near-circle or circle in order to minimize the coil length (winding length of the coil 12) needed to achieve a specified number of windings and thereby reduce electrical resistance, but its section shape is not limited to the foregoing. In addition, preferably the bottom flange 11*c* has a profile whose shape is a near square or square in a plan view in order to reduce the inductor 10 size to support high-density mounting, but its profile is not limited to the foregoing and can be a polygon, near-circle, etc. Furthermore, preferably the top flange 11*b* has a profile whose shape is similar to that of the bottom flange 11*c*, but its shape is not limited as is the case with the bottom flange 11*c*, and it is also preferable that the top flange 11*b* is slightly smaller than the bottom flange 11*c* in order to prevent dripping of the sealing material 18 when the material is applied.

Provided on a bottom face 11B of the bottom flange 11*c* are the pair of electrodes 16A, 16B facing each other symmetrically over a center axis CL of the winding core 11*a*. The area on this bottom face 11B in which the pair of electrodes 16A, 16B are to be formed (electrode-forming area) can have, for example, grooves 15A, 15B formed in it beforehand.

Preferably a base material constituted by an aggregate of soft magnetic alloy particles is used for the core 11. Here, "soft magnetic" refers to a property characterized by small magnetic coercive force and high magnetic permeability. Also, "alloy" refers to a substance constituted by a single metal (pure metal constituted by a single metal element) to which at least one type of metal or nonmetal has been added, where such substance has metallic property (has free electrons, exhibits good electrical conductivity or thermal conductivity, has metallic gloss, and so on). Additionally, "particle" refers to a fine "grain" constituting the substance, while "aggregate" refers to a group of these particles.

The aggregate of soft magnetic alloy particles used for the core 11 can contain iron (Fe), silicate (Si), and another element that oxidizes more easily than iron. For the element that oxidizes more easily than iron, chromium (Cr) or Aluminum (Al) can be used, for example.

By using an aggregate of soft magnetic alloy particles for the core 11, as described above, and also by properly setting the content of the "element that oxidizes more easily than iron (chromium or aluminum in the above example)" in the soft magnetic alloy particle as well as the average particle size of the soft magnetic alloy particles, high saturated magnetic flux and high magnetic permeability can be realized and these high saturated magnetic flux and high magnetic permeability will improve DC superimposition characteristics.

The coil 12 is a so-called coated conductive wire constituted by a metal wire 13 of copper (Cu), silver (Ag), etc., having an insulation coat 14 of polyurethane resin, polyester resin, etc., formed on its outer periphery, and this coated conductive wire (coil 12) is wound around the winding core 11*a* by a specified number of times, after which the one end and other end 13A, 13B of the coil 12 are electrically connected to the electrodes 16A, 16B via solder 17A, 17B with the insulation coat 14 removed from the ends.

If the electrodes 16A, 16B are provided in grooves 15A, 15B, preferably the diameter of the ends 13A, 13B of the coil 12 is greater than the depth of the grooves 15A, 15B.

The coil 12 can be a coated conductive wire of approx. 0.1 to 0.2 mm in diameter, for example. The number of windings of the coil 12, or specifically the number of times it is wound around the winding core 11*a*, can be set to approx. 3.5 times to 15.5 times, for example.

The metal wire 13 that can be used for the coil 12 may be a single wire, but it is not limited to the foregoing and two or more wires can be combined or stranded, for example. In addition, the metal wire 13 can be a wire having a circular section, or it can be a wire having a rectangular section (so-called rectangular wire) or wire having a square section (so-called square wire).

Electrical connection between the ends 13A, 13B of the coil 12 and the electrodes 16A, 16B can be implemented not only via solder, but also by intermetallic bond achieved by thermally bonding the electrodes 16A, 16B and the ends 13A, 13B of the coil 12. In the latter case, the bonded locations can be covered (coated) with solder.

Next, the sealing material 18, which is a key point of the embodiment, is explained.

The sealing material 18 coats the outer periphery of the coil 12 that has been wound around the winding core 11*a* of the core 11, while at the same time this sealing material has specified fluidity to fully plug (fill) the voids bounded by the winding core 11*a*, top flange 11*b* and bottom flange 11*c*, and it also hardens under heat.

As an example, use of thermosetting resin containing soft magnetic alloy powder (hereinafter referred to as "soft magnetic alloy powder-containing resin") for this sealing material 18 can be considered. This is because it will improve DC superimposition characteristics just like when the core 11 constituted by an aggregate of soft magnetic alloy particles is used. For example, a resin material having specified visco-elasticity in the service temperature range of the inductor 10, to which an inorganic filler constituted by magnetic powder, silica ($SiO_2$) or other inorganic material has been added to a specified ratio, can be used for this soft magnetic alloy powder-containing resin. To be more specific, a soft magnetic alloy powder-containing resin can be used whose glass transition temperature in the course of changing from glass state to rubber state as its physical property (changes of modulus of rigidity with temperature) as a property when the resin hardens, is 100 to 150° C. In addition, epoxy resin, or mixed resin containing epoxy resin and phenol resin, can be used for the base thermosetting resin material, for example.

Furthermore, use of any of various types of magnetic powder constituted by Fe—Cr—Si alloy, Mn—Zn ferrite, Ni—Zn ferrite, etc., as well as silica ($SiO_2$), etc., for visco-elasticity adjustment, can be considered for the inorganic filler contained in the soft magnetic powder-containing resin. For the magnetic powder having specified magnetic permeability, any magnetic powder having the same composition as the soft magnetic alloy particle constituting the core 11, or other powder containing such magnetic powder, can be used, for example. In this case, the average particle size of the magnetic powder can be adjusted to approx. 2 to 30 μm or so, and also the inorganic magnetic powder filler can be contained by approx. 50 percent by volume or more in the soft magnetic alloy powder-containing resin.

When the sealing material 18 thus illustrated is used, however, a low wettability of the alloy powder relative to the resin component would result in poor fluidity of the sealing material 18, which would then prevent smooth application of the amount of resin needed to achieve the target shape and characteristics, as revealed by an experiment conducted by the inventors of the present invention.

To solve the above problem, the inventors of the present invention studied repeatedly in earnest and found that, by using an amorphous alloy powder free from crystallinity for the soft magnetic alloy powder contained in the sealing material 18, and also by meeting the conditions specified below, wettability of the alloy powder relative to the resin component can be improved.

<Condition 1>

The amorphous alloy powder contained in the sealing material 18 shall have at least two peaks (hereinafter referred to as "first peak and second peak") in its particle size distribution, and the particle sizes corresponding to these peaks shall have the relationship of "First peak>Second peak."

<Condition 2>

The particle size corresponding to the second peak shall be equal to or smaller than one-half (or preferably equal to or smaller than one-third) the particle size corresponding to the first peak. Approx. one-tenth is considered the limit of how much "smaller" the particle size can be below one-half or one-third. This is because the surface area of the particle per volume increases as the particle size decreases, causing the TI value described later to rise and inhibiting fluidity contrary to the original intention. The limit is thus estimated as approx. one-tenth.

<Condition 3>

The magnitude ratio (abundance ratio) of the second peak and first peak shall be 0.2 or more but 0.6 or less (or preferably 0.25 or more but 0.4 or less), such as 0.3 or so.

<Condition 4>

Particle sizes at the first peak shall be distributed roughly around 22 μm.

<Condition 5>

D90 of the particle size distribution shall be roughly 60 μm or less.

It was found that the aforementioned wettability problem, or specifically the problem of not being able to smoothly apply the amount of resin needed to achieve the target shape and characteristics due to poor fluidity of the sealing material 18, which in turn is caused by a low wettability of the alloy powder relative to the resin component, can be solved by applying the sealing material 18 meeting all or any of the five conditions specified above, to the inductor 10 in the embodiment, or specifically a coil body (inductor 10) whose constitution is summarized as forming a core 11 by molding soft magnetic alloy powder (such as Fe—Cr—Si soft magnetic alloy powder) and heating the molded powder to bind the powder particles together via oxide film, and then winding a conductive wire coated with urethane, etc. (metal wire 13 with an insulation coat 14 formed on its outer periphery) around the core 11 thus obtained and connecting it to the terminals (electrodes 16A, 16B).

Here, D50 refers to the diameter (median diameter) representing a certain particle size that divides powder particles into two groups of large and small particles of equal amounts. Although D10, D50, and D90 are commonly used and refer to particle size values indicating that, respectively, 10%, 50%, and 90% of the particle size distribution are below these values (using a volume-based calculation), D90 is used here, which specifically means that particle sizes included in 90% of the particle size distribution are approximately 60 μm or less.

Also, "particle size distribution" refers to an indicator of particles of which sizes (particle sizes) are contained at which ratios (relative particle masses based on 100% representing the total) in the sample particle group being measured. It is also called "granularity distribution" or "frequency distribution."

In addition, "peak" refers to an explicit prominence point of relative particle mass (point indicating an explicitly prominent relative particle mass) in this particle size distribution (frequency distribution). The "peak" may also be defined as an apex of a particle size distribution curve having a value, 0.95 of which is greater than a value of a nadir between the peak and an adjacent peak.

To introduce the concept of particle size distribution (frequency distribution), however, "particle size" must be defined. This is because a majority of particles have a shape that is not simple and quantifiable such as sphere or cube, but complex and irregular instead, and therefore the particle size cannot be defined directly. For this reason, generally the (indirect) definition of "sphere-equivalent size" is used as a matter of convenience. This provides a convenient way of measurement where the diameter of a "model sphere" that gives the same result (measured amount or pattern) when a specific particle is measured based on a specific measurement principle is "considered" the particle size of the measured particle. Under the "sedimentation method," for example, measured particles having the same sedimentation speed as the model sphere of 1 μm in diameter made of the same substance as the measured particle, are considered to have a particle size of 1 μm. Under the "laser diffraction/scattering method," measured particles indicating the same pattern of diffracted/scattered light as the model sphere of 1 μm in diameter, are considered to have a particle size of 1 μm regardless of their shape.

Figure 2:
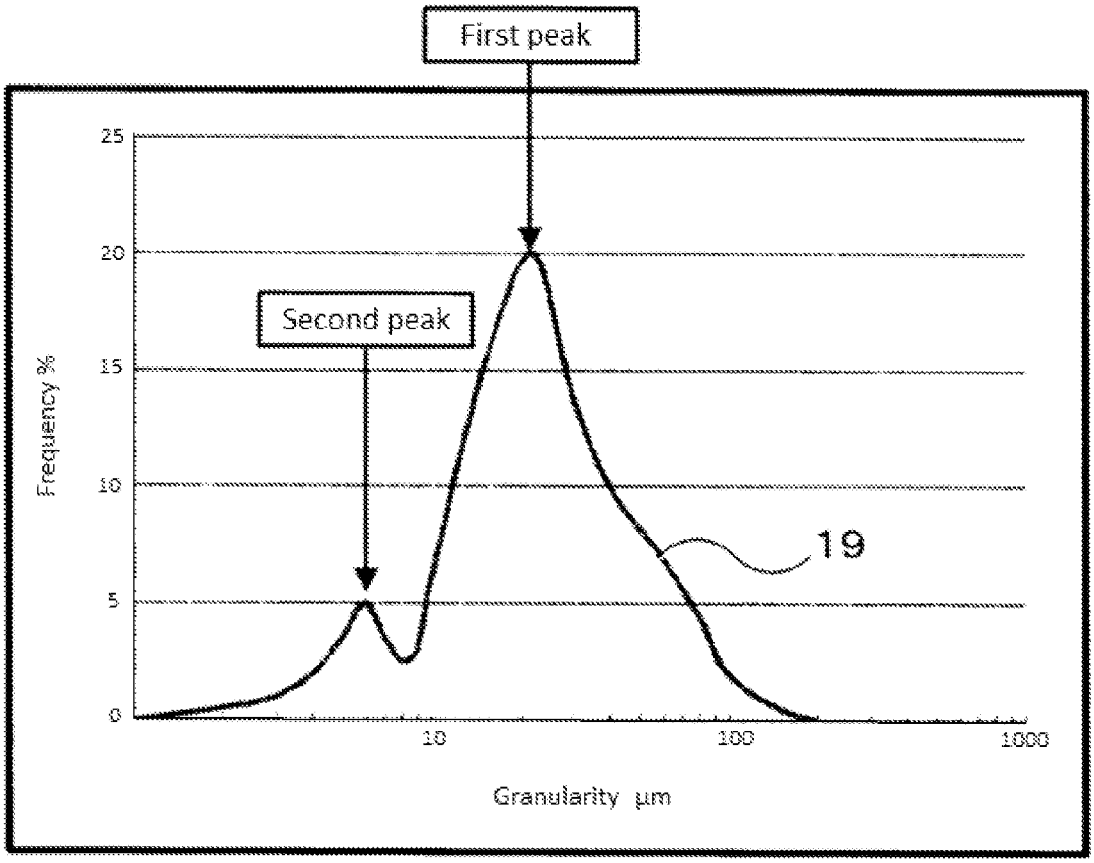
FIG. 2 is a graph showing the particle size distribution (frequency distribution) of the sealing material 18.

FIG. 2 is a graph showing the particle size distribution (frequency distribution) of the sealing material 18. In this figure, the horizontal axis represents particle size (unit: μm) that indicates particle size, while the vertical axis represents frequency (unit: %) that indicates relative particle mass. In this figure, a line 19 shows two explicit singular points, one high and one low. When the singular point of the higher frequency is called the "first peak" and that of the lower frequency, the "second peak," these two peaks have the relationship of "First peak>Second peak," meaning that Condition 1 above is satisfied.

Granularities at the first peak are distributed roughly around 22 μm, while granularities at the second peak are distributed roughly around 5 μm, and furthermore the frequency is approx. 21% at the first peak and approx. 4% at the second peak. Since the granularities at the first peak and second peak are roughly 22 μm and 5 μm, respectively, Condition 4 above is satisfied. Also because granularities at the second peak (roughly 5 μm) are approx. one-fourth of those at the first peak (roughly 22 μm), the former is equal to or smaller than one-half (or equal to or smaller than one-third) of the latter, which satisfies Condition 2 above.

In addition, an equivalent to 90% of the area bounded by the line 19 is accounted for by granularities of approx. 60 μm or less, meaning that Condition 5 above is satisfied.

Figure 3:
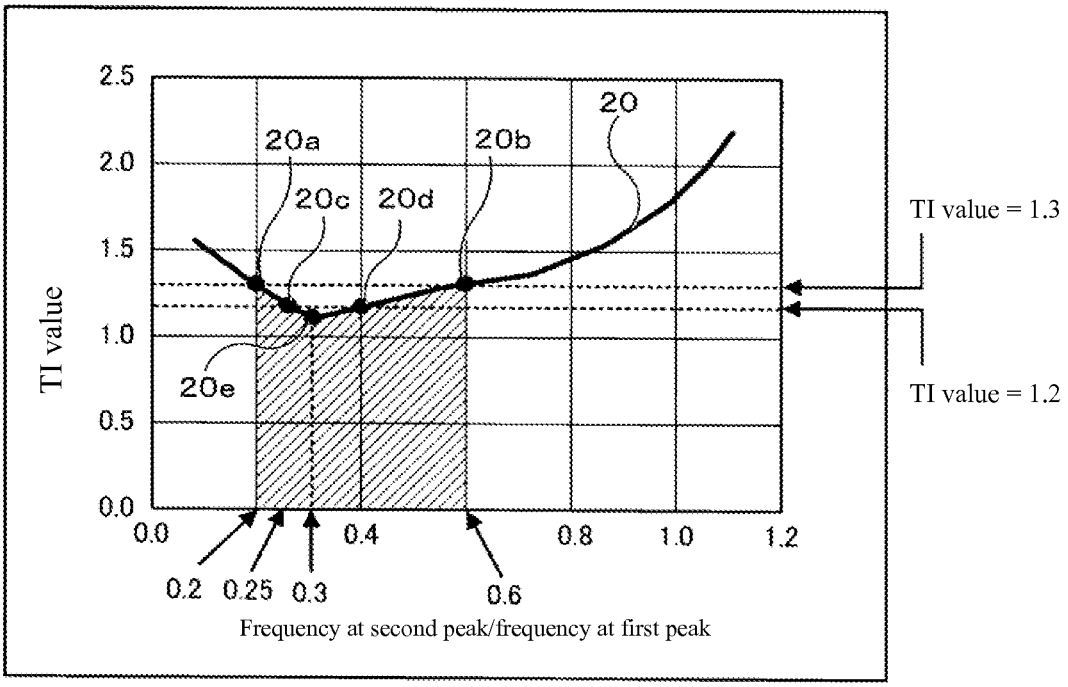
FIG. 3 is a graph showing the magnitude ratio (abundance ratio) of the first peak and second peak.

FIG. 3 is a graph showing the magnitude ratio (abundance ratio) of the first peak and second peak. In this figure, the horizontal axis represents the value obtained by dividing the frequency at the second peak by the frequency at the first peak (i.e., magnitude ratio), while the vertical axis represents the TI (thixotropic index) value. Here, the TI value is an index of structural viscosity used frequently in the coating material industry, etc., which is in essence a quantitative representation of fluidity. The closer the TI value to 1, the more fluid the material (the higher its fluidity) becomes due to Newtonian flow. The TI value in the figure was obtained by measuring the viscosities at 5 rpm and 50 rpm using a BH rotary viscometer and then calculating "Measured viscosity at 5 rpm/Measured viscosity at 50 rpm."

As mentioned above, the closer the TI value to 1, the more fluid the material becomes due to Newtonian flow, meaning the smoother the flow becomes. Accordingly, when "TI value=1.3 or less" along a line 20 in this figure is set as the target range where good fluidity can be achieved (hatched area where the lines decline from right to left), for example, the magnitude ratio at one point 20*a* on the line 20 intersecting with the TI value of 1.3 becomes 0.2, while the magnitude ratio at another point 20*b* becomes 0.6, meaning that the magnitude ratio (abundance ratio) of the first peak and second peak is 0.2 or more but 0.6 or less and Condition 3 above is satisfied in the example illustrated.

Incidentally, "TI value=1.3 or less" is selected because this setting generates necessary resin flow sufficient to fill the voids after resin is applied, even if insufficient filling occurs during application.

The TI value is not limited to this example (TI value=1.3 or less). If smoother flow of resin is intended, the TI value can be made closer to 1 than as the one illustrated above. For example "TI value=1.2 or less" is permitted. In this case, the magnitude ratio at one point 20*c* on the line 20 intersecting with the TI value of 1.2 becomes 0.25, while the magnitude ratio at another point 20*d* becomes 0.4, meaning that the magnitude ratio (abundance ratio) of the first peak and second peak is 0.25 or more but 0.4 or less and the preferable variation of Condition 3 above is satisfied.

Here, the magnitude ratio at a point 20*e* on the line 20 in the figure where the TI value becomes the smallest is approx. 0.3, which also satisfies an example value (such as approx. 0.3) of Condition 3 above.

As explained above, all of the aforementioned conditions (Conditions 1 to 5) are satisfied according to the particle size distribution (frequency distribution) of the sealing material 18 as shown in FIG. 2, and also to the magnitude ratio (abundance ratio) of the first peak and second peak as shown in FIG. 3.

Accordingly, the aforementioned wettability problem, or specifically the problem of not being able to smoothly apply the amount of resin needed to achieve the target shape and characteristics due to poor fluidity of the sealing material 18, which in turn is caused by a low wettability of the alloy powder relative to the resin component, can be solved by applying the sealing material 18 meeting all or any of the conditions specified above to the inductor 10, or specifically by applying the sealing material 18 meeting all or any of the conditions specified above to a coil body (inductor 10) whose constitution is summarized as forming a core 11 by molding soft magnetic alloy powder (such as Fe—Cr—Si soft magnetic alloy powder) and heating the molded powder to bind the powder particles together via oxide film, and then winding a conductive wire coated with urethane, etc. (metal wire 13 with an insulation coat 14 formed on its outer periphery) around the core 11 thus obtained and connecting it to the terminals (electrodes 16A, 16B).

Fluidity of the sealing material 18 improves, as described above, probably because the amorphous alloy powder easily adapts to the liquid component at its surface and, also as smaller alloy powder particles fill the gaps between larger alloy powder particles, the apparent fill volume decreases compared to powder of single particle size.

Next, how the coil 12 in the embodiment is coated (sealed) is explained.

Figure 4:
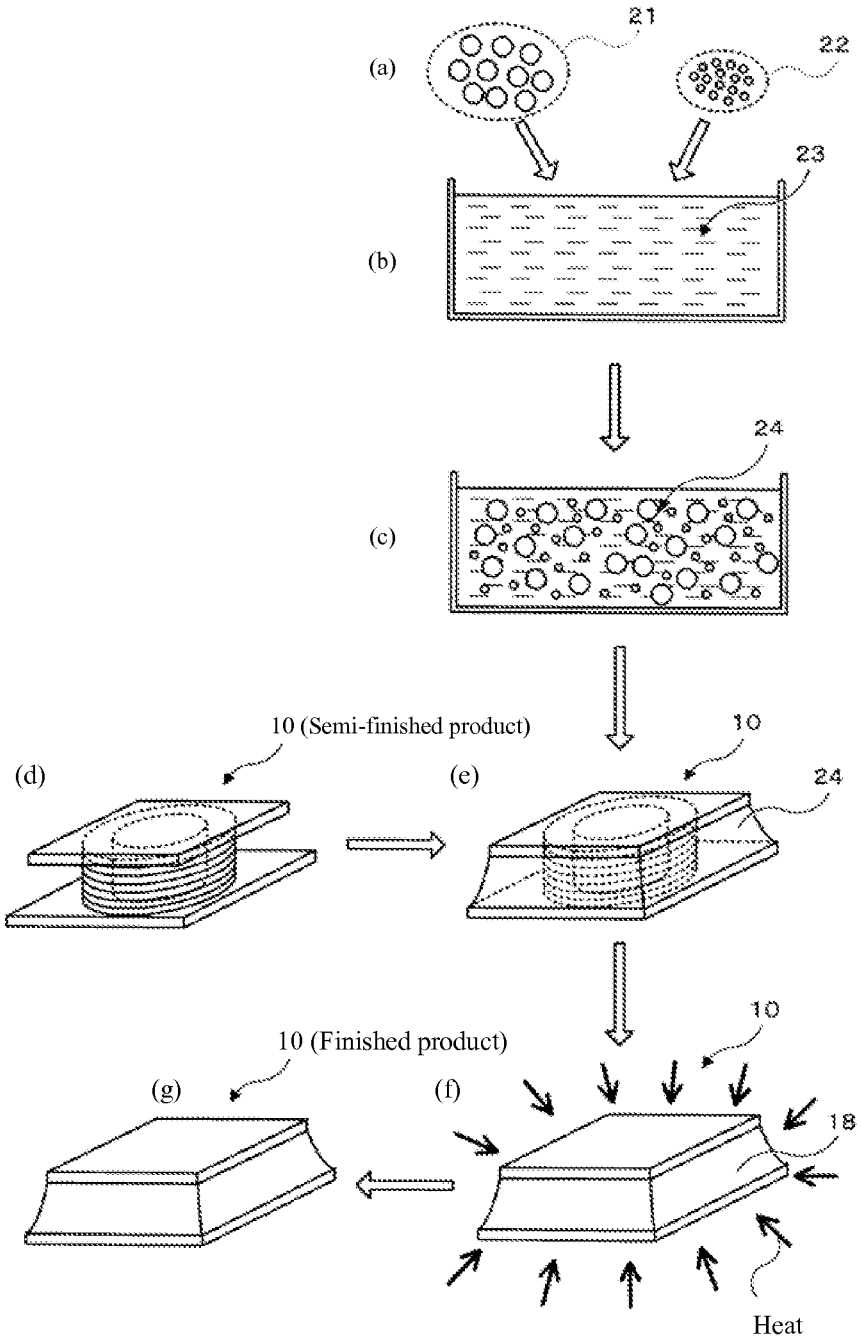
FIG. 4 is a concept drawing explaining how the coil 12 is coated (sealed).

FIG. 4 is a concept drawing explaining how the coil 12 is coated (sealed).

a) (corresponding to (a) in FIG. 4) First, a first particle group 21 and second particle group 22 are prepared. These two particle groups (first particle group 21 and second particle group 22) are each soft magnetic alloy powder, or to be more specific, soft magnetic amorphous alloy powder free from crystallinity. For this alloy powder, magnetic powder (it must be amorphous alloy powder) having the same composition as the soft magnetic alloy powder constituting the core 11 can be used, for example.

The first particle group 21 dominantly includes large particles having the first peak mentioned above, while the second particle group 22 dominantly includes small particles having the second peak mentioned above. As mentioned above, the particle sizes corresponding to these peaks meet the relationship of "First peak>Second peak" (Condition 1); the particle size corresponding to the second peak is equal to or smaller than one-half (or preferably equal to or smaller than one-third) the particle size corresponding to the first peak (Condition 2); particle sizes at the first peak are distributed roughly around 22 μm (Condition 4); the magnitude ratio (abundance ratio) of the second peak and first peak is 0.2 or more but 0.6 or less (or preferably 0.25 or more but 0.4 or less), such as 0.3 or so (Condition 3); and D90 of the particle size distribution of the first particle group 21 and second particle group 22 is roughly 60 μm or less (Condition 5).

b) (corresponding to (b) in FIG. 4) Next, the above two particle groups (first particle group 21 and second particle group 22) are introduced to a thermosetting resin material 23 in liquid state. The two particle groups (first particle group 21 and second particle group 22) can be input by, for example, an equivalent of 50 percent by volume or more based on equivalent weight ratio. For the thermosetting resin material 23, epoxy resin or mixed resin containing epoxy resin and phenol resin can be used, for example.

c) (corresponding to (c) in FIG. 4) Next, the resin material 23 is agitated to produce mixed liquid in which the two particle groups (first particle group 21 and second particle group 22) are fully mixed (soft magnetic alloy powder-containing resin 24).

d) (corresponding to (d) in FIG. 4) Next, a semi-finished inductor 10 (whose coil 12 is exposed) is prepared, and e) (corresponding to (e) in FIG. 4) the soft magnetic alloy powder-containing resin 24 is applied to the outer periphery of the coil 12.

Here, the soft magnetic alloy powder-containing resin 24 satisfying the aforementioned conditions (Conditions 1 to 5) has good fluidity (of at least TI=1.3 or less). Accordingly, the soft magnetic alloy powder-containing resin 24 not only covers the outer periphery of the coil 12, but it also smoothly enters the gaps between adjacent loops of the coil 12, gaps between the coil 12 and winding core 11*a*, gaps between the coil 12 and top flange 11*b*, and gaps between the coil 12 and bottom flange 11*c*, and so on, and consequently substantially all the gaps can be filled and sealed completely.

Also, while the soft magnetic alloy powder-containing resin 24 must be applied to all four sides of the semi-finished inductor 10 (whose coil 12 is exposed), this application process can be simplified. For example, only one of the four sides is coated, only two opposing sides are coated, or only two adjacent sides are coated, with the soft magnetic alloy powder-containing resin 24 let travel (spread) naturally to the remaining sides by utilizing its fluidity. This way, the application process can be simplified and workability improved, which is desirable.

f) (corresponding to (f) in FIG. 4) Finally, the inductor 10 whose coil 12 has been sealed by the soft magnetic alloy powder-containing resin 24 is heat-treated to cure the soft magnetic alloy powder-containing resin 24 so that it serves as the sealing material 18, and g) (corresponding to (g) in FIG. 4) the inductor 10 having the structure shown in FIG. 1 is now complete.

As explained above, a unique effect of completely sealing the coil 12 of the inductor 10 without leaving any gaps can be achieved according to the technology of the embodiment. Also, use of soft magnetic alloy powder-containing resin for the sealing material 18 produces an effect of achieving excellent DC superimposition characteristics. It is also possible not to coat all four sides, but to coat only one side, only two opposing sides, or only two adjacent sides and let the resin spread to the remaining sides, which has the effect of simplifying the application process.

Furthermore, since this sealing technology is different from the prior art involving "pressure-molding" as described in the initial part hereof, it has the effect of eliminating various mechanical problems associated with pressurization, such as deformation of the coil and displacement of the winding position.

INDUSTRIAL APPLICATION

The present invention is well suited for "coil-type inductors," and in particular, it is well suited for inductors used in DC-DC converters and other applications where large current is applied. The present invention can also be applied to general fillers used in electromagnetic shield applications where small gaps must be filled.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" or "an" may refer to a species or a genus including multiple species, and "the invention" or "the present invention" may refer to at least one of the embodiments or aspects explicitly, necessarily, or inherently disclosed herein. In this disclosure, any defined meanings do not necessarily exclude ordinary and customary meanings in some embodiments.

The present application claims priority to Japanese Patent Application No. 2012-150164, filed Jul. 4, 2012, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. An inductor that uses soft magnetic alloy powder-containing resin that contains amorphous soft magnetic alloy powder, which resin is used as a sealing material that seals a coil wound around a winding core of a core, wherein:

the soft magnetic alloy powder-containing resin contains two groups of large and small particles separately dispersed in a cured resin, and seals the coil without compression, said two groups of large and small particles having a first peak and a second peak in their particle size distribution, respectively;

a particle size corresponding to the second peak is equal to or smaller than one-half a particle size corresponding to the first peak, and an magnitude ratio (abundance ratio) of the second peak and first peak is 0.2 or more but 0.6 or less; and a top flange is formed integrally on a top end of the winding core, and a bottom flange is formed integrally on a bottom end of the winding core, wherein the bottom flange is larger than the top flange to inhibit dripping of the sealing material when the material is applied.

2. An inductor according to claim 1, wherein the magnitude ratio (abundance ratio) of the second peak and first peak is 0.25 or more but 0.4 or less.

3. An inductor according to claim 1, wherein the particle size corresponding to the second peak is equal to or smaller than one-third the particle size corresponding to the first peak.

4. An inductor according to claim 1, wherein particle sizes included in 90% of the particle size distribution are 60 μm or less.

5. An inductor according to claim 1, which comprises a coil body constituted by the core produced by molding soft magnetic alloy powder and heating the molded powder, and a coated conductive wire wound around the core and connected to terminals, wherein the powder particles are bonded together by oxide film.

6. An inductor according to claim 2, which comprises a coil body constituted by the core produced by molding soft magnetic alloy powder and heating the molded powder, and a coated conductive wire wound around the core and connected to terminals, wherein the powder particles are bonded together by oxide film.

7. An inductor according to claim 3, which comprises a coil body constituted by the core produced by molding soft magnetic alloy powder and heating the molded powder, and a coated conductive wire wound around the core and connected to terminals, wherein the powder particles are bonded together by oxide film.

8. An inductor according to claim 4, which comprises a coil body constituted by the core produced by molding soft magnetic alloy powder and heating the molded powder, and a coated conductive wire wound around the core and connected to terminals, wherein the powder particles are bonded together by oxide film.

9. An inductor according to claim 1, wherein particles sizes at the first peak are distributed around 22 μm.

10. An inductor according to claim 1, wherein voids between loops of the wound coil are filled with the soft magnetic alloy powder-containing resin.

11. An inductor according to claim 1, wherein the wound coil is entirely sealed by the soft magnetic alloy powder-containing resin as the outermost layer.

12. An inductor according to claim 1, wherein the soft magnetic alloy powder-containing resin consists of the two groups of large and small particles and the resin.

* * * * *